US011345560B2

(12) United States Patent
Kondo et al.

(10) Patent No.: US 11,345,560 B2
(45) Date of Patent: May 31, 2022

(54) SHEET DISCHARGING DEVICE, PROCESSING DEVICE, AND RECORDING SYSTEM

(71) Applicant: SEIKO EPSON CORPORATION, Tokyo (JP)

(72) Inventors: Katsuyuki Kondo, Nagano (JP); Chiaki Shimada, Nagano (JP); Tsuyoshi Furumido, Nagano (JP); Atsushi Nakazawa, Nagano (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/038,978

(22) Filed: Sep. 30, 2020

(65) Prior Publication Data

US 2021/0094788 A1 Apr. 1, 2021

(30) Foreign Application Priority Data

Sep. 30, 2019 (JP) ..... JP2019-179233

(51) Int. Cl.
*B65H 31/34* (2006.01)

(52) U.S. Cl.
CPC ..... *B65H 31/34* (2013.01)

(58) Field of Classification Search
None
See application file for complete search history.

(56) References Cited

U.S. PATENT DOCUMENTS

| | | | | |
|---|---|---|---|---|
| 6,231,039 | B1 * | 5/2001 | Chung | B65H 31/02 270/58.01 |
| 6,722,646 | B2 * | 4/2004 | Sekiyama | B65H 43/06 270/58.09 |
| 8,220,794 | B2 * | 7/2012 | Terao | B65H 31/3081 270/58.09 |
| 2015/0203321 | A1 * | 7/2015 | Kimura | B65H 31/24 270/58.13 |
| 2015/0309463 | A1 * | 10/2015 | Masunari | B65H 31/3018 412/16 |

FOREIGN PATENT DOCUMENTS

| | | |
|---|---|---|
| JP | 2002249275 A | 9/2002 |
| JP | 2013052937 A | 3/2013 |
| JP | 2018024505 A | 2/2018 |

* cited by examiner

*Primary Examiner* — Leslie A Nicholson, III
(74) *Attorney, Agent, or Firm* — Chip Law Group

(57) ABSTRACT

A sheet discharging device includes: a pair of medium supporting portions that have support surfaces that support the medium, and support the transported medium by the support surfaces; a stacking portion which is provided vertically below the pair of medium supporting portions and on which the medium dropped from the pair of medium supporting portions is stacked; and a standing wall that aligns the medium by contacting a rear end of the medium in the transport direction supported by the pair of medium supporting portions, and the standing wall includes: a center contacting wall that is provided at a center in the width direction and contacts the rear end of the medium; and recess portions that are provided on both sides of the center contacting wall in the width direction and are recessed in a direction away from the support surfaces.

9 Claims, 11 Drawing Sheets

SHEET DISCHARGING DEVICE, PROCESSING DEVICE, AND RECORDING SYSTEM

The present application is based on, and claims priority from JP Application Serial Number 2019-179233, filed Sep. 30, 2019, the disclosure of which is hereby incorporated by reference here in its entirety.

BACKGROUND

1. Technical Field

The present disclosure relates to a sheet discharging device including a medium supporting portion that supports at least a tip portion of a transported medium and a stacking portion that stacks the medium dropped from the medium supporting portion, a processing device including the sheet discharging device, and a recording system including the processing device.

2. Related Art

JP-A-2013-52937 discloses a processing device having a structure which includes a jogger stacking portion having a pair of left and right joggers that support, align, and stack a transported medium and in which the pair of left and right joggers are opened to drop and stack the bundle of the aligned medium on a stacking portion called a stacking tray. A medium support surface of the jogger is an inclined surface in which a downstream in a transport direction faces the upper side. The medium is supported by the medium support surface in an inclined state in which a rear end on an upstream in the transport direction is located on the lower side, and an edge of the rear end of the medium is in contact with and supported by a support.

When the bundle of the medium is dropped and stacked onto the stacking portion by opening the pair of left and right joggers, the medium starts to be dropped from left and right central portions. The medium that starts to be dropped is deformed into a U shape as a whole. When a degree of the deformation into the U shape increases, the central portion of the medium is displaced forward from a position immediately before the dropping due to the influence of the inclined surface structure. There is a problem in that due to the forward displacement, the position of each bundle of the mediums dropped onto the stacking portion varies in the transport direction, and a stacking position also varies in the transport direction.

However, JP-A-2013-52937 does not have description or suggestion that considers a problem that the position of each bundle of the medium dropped onto the stacking portion varies in the transport direction.

SUMMARY

A sheet discharging device according to the present disclosure for solving the above-described problems includes: a pair of medium supporting portions that are provided to face each other in a width direction intersecting a transport direction in which a medium is transported, have support surfaces that support the medium, and support the transported medium by the support surfaces; a stacking portion which is provided vertically below the pair of medium supporting portions and on which the medium dropped from the pair of medium supporting portions is stacked; and a standing wall that aligns the medium by contacting a rear end of the medium in the transport direction supported by the pair of medium supporting portions, in which the support surfaces are inclined upward toward a downstream in the transport direction, and the standing wall includes: a center contacting wall that is provided at a center in the width direction and contacts the rear end of the medium; and recess portions that are provided on both sides of the center contacting wall in the width direction and are recessed in a direction away from the support surfaces.

BRIEF DESCRIPTION OF THE DRAWINGS

FIG. 9A illustrates a driving structure of a transport driving roller, in which FIG. 9A is an overall perspective view.

FIG. 9B illustrates a driving structure of the transport driving roller, in which FIG. 9B is an enlarged perspective view of a drive gear portion.

FIG. 9C illustrates a driving structure of the transport driving roller, in which FIG. 9C is a view taken along line IXC-IXC of FIG. 9A.

DESCRIPTION OF EXEMPLARY EMBODIMENTS

Figure 1:
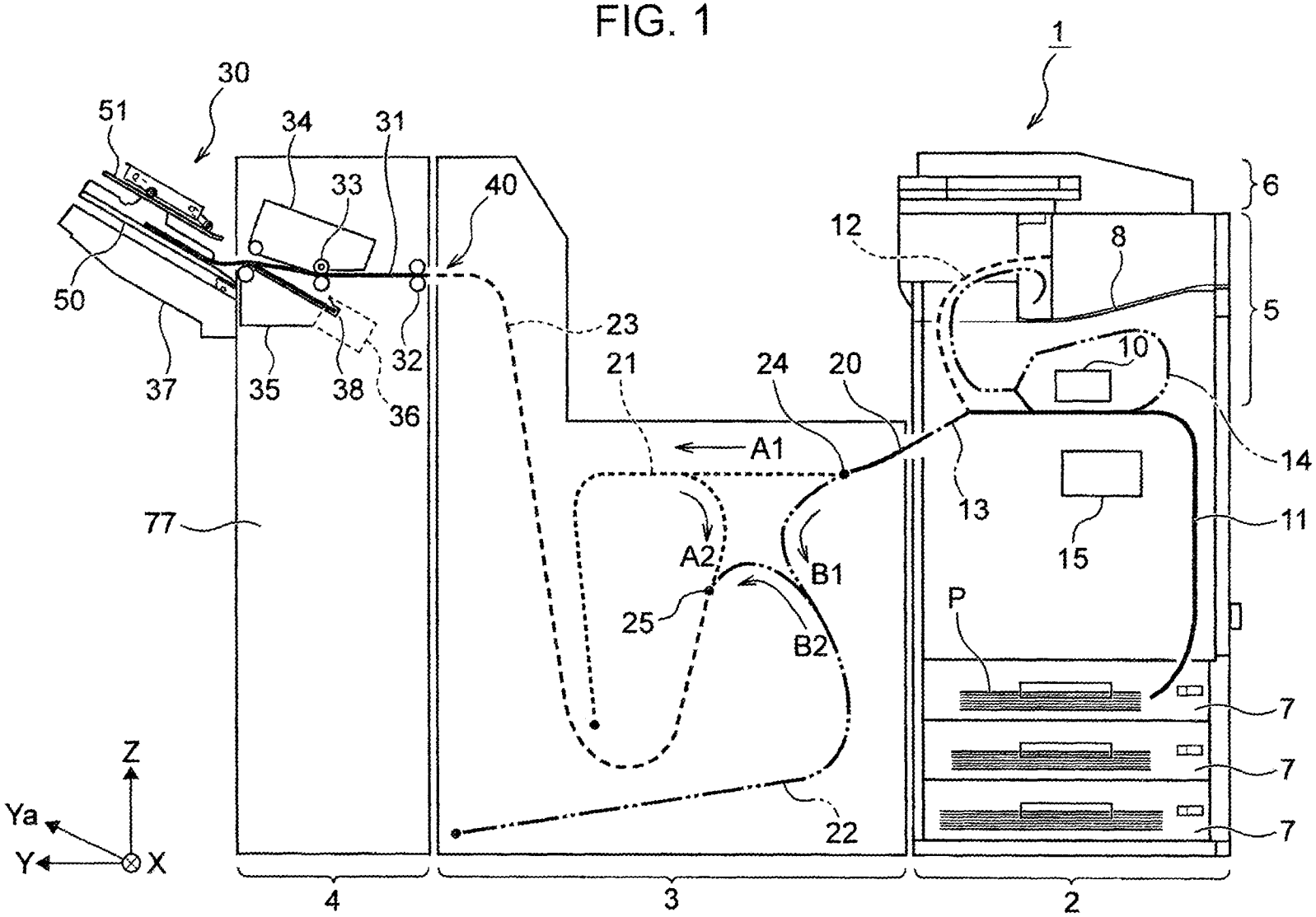
FIG. 1 is a schematic view illustrating a recording system according to the present embodiment.

First, the present disclosure will be briefly described.

A sheet discharging device according to a first aspect of the present disclosure includes: a pair of medium supporting portions that are provided to face each other in a width direction intersecting a transport direction in which a medium is transported, have support surfaces that support the medium, and support the transported medium by the support surfaces; a stacking portion which is provided vertically below the pair of medium supporting portions and on which the medium dropped from the pair of medium supporting portions is stacked; and a standing wall that aligns the medium by contacting a rear end of the medium in the transport direction supported by the pair of medium supporting portions, in which the support surfaces are inclined upward toward a downstream in the transport direction, and the standing wall includes: a center contacting wall that is provided at a center in the width direction and contacts the rear end of the medium; and recess portions that are provided on both sides of the center contacting wall in the width direction and are recessed in a direction away from the support surfaces.

According to this aspect, the standing wall includes a center contacting wall that is provided at a center in the width direction and contacts the rear end of the medium, and recess portions that are provided on both sides of the center contacting wall in the width direction and are recessed in a direction away from the support surfaces. Accordingly, even when the medium supported by the pair of medium supporting portions starts to be dropped and is deformed into a U shape as a whole, and both corner portions of the edge of the rear end of the medium are displaced rearward from a position immediately before the above-described dropping, the both corner portions of the edge of the rear end can enter the recess portions.

Thus, the medium starts to be dropped in a state in which a central portion of the edge of the rear end thereof contacts the center contacting wall, and the both corner portions of the edge of the rear end of the medium enter the recess portions, so that there is little risk of contact with walls of surrounding members. Thus, it is possible to suppress the position of each bundle of the medium dropped onto the stacking portion from varying in the transport direction, and thus to suppress a problem that a stacking position varies in the transport direction.

A second aspect of the present disclosure provides the sheet discharging device according to the first aspect, in which the pair of medium supporting portions are movable in the width direction, and the center contacting wall guides the medium to the stacking portion when the pair of medium supporting portions move in a direction away from each other and the medium is dropped.

Here, the number of the "center contacting wall" is not limited to one, and may be two or more. When there are two or more center contacting walls, the recess portions are provided outside the outermost one of the center contacting walls in the width direction.

According to this aspect, the center contacting wall guides the medium to the stacking portion when the pair of medium supporting portions move in a direction away from each other and the medium is dropped. Accordingly, since the medium starts to be dropped in a state in which the central portion of the edge of the rear end thereof contacts the center contacting wall, is guided by the center contacting wall as it is, and is led to the stacking portion, it is possible to effectively suppress a problem that the position of the bundle of the medium dropped onto the stacking portion varies in the transport direction.

A third aspect of the present disclosure provides the sheet discharging device according to the first aspect or the second aspect, further comprising a stacking standing wall that aligns the medium by contacting the rear end of the medium supported by a stacking surface of the stacking portion, in which the center contacting wall and the stacking standing wall have contact surfaces that contact the rear end of the medium in a same plane.

Here, the contact surfaces of the center contacting wall and the stacking standing wall may that the contact surfaces are offset from each other within a range in which the contact surface of the center contacting wall can smoothly guide and stack the dropping medium onto the stacking surface.

According to this aspect, the center contacting wall and the stacking standing wall have contact surfaces that contact the rear end of the medium in a same plane. Accordingly, the medium starts to be dropped in a state in which the central portion of the edge of the rear end thereof contacts the center contacting wall, is guided by the center contacting wall as it is, and is delivered to the stacking standing wall of the stacking portion. Therefore, the medium dropped onto the stacking portion is stacked in a state in which the rear end contacts the stacking standing wall of the stacking portion at the dropped position as it is, and a problem that the position of the bundle of the mediums varies in the transport direction can be suppressed.

A fourth aspect of the present disclosure provides the sheet discharging device according to the first aspect or the second aspect, further comprising a plurality of receiving portions that are movable between a protrusion position where the receiving portions protrude inward from the recess portions on both sides of the center contacting wall and a retraction position where the receiving portions are retracted from the recess portions, in which the plurality of receiving portions align the rear end of the medium supported by the support surfaces together with the center contacting wall in a state in which the receiving portions move to the protrusion position.

According to this aspect, the plurality of receiving portions align the rear end of the medium supported by the support surfaces together with the center contacting wall in a state in which the receiving portions move to the protrusion position. Accordingly, when the medium supported by the pair of medium supporting portions is aligned, both the center contacting wall and the receiving portion contact the rear end of the medium, so that the medium is less likely to be tilted in the transport direction, and disturbance of the aligning can be suppressed.

A fifth aspect of the present disclosure provides the sheet discharging device according to fourth aspect, in which when the pair of medium supporting portions drop the medium onto the stacking portion, the plurality of receiving portions move to the retraction position.

According to this aspect, when the medium supported by the medium supporting portion is dropped, the receiving portion moves to the retraction position, so that the recess portion becomes functional, and a problem that the position of the bundle of the medium dropped onto the stacking portion varies in the transport direction can be suppressed.

A sixth aspect of the present disclosure provides the sheet discharging device according to the first aspect to the fifth aspect, in which the recess portions are configured so that at least a part of the rear end of the medium stacked on the stacking portion enters.

According to this aspect, since the recess portion is configured such that at least a part of the rear end of the medium P stacked on the stacking portion can enter the recess portion, when the medium in a state of being stacked on the stacking portion has deformation such as curl, the deformed portion can be escaped to the recess portion, and a damage to the medium can be reduced.

A seventh aspect of the present disclosure provides the sheet discharging device according to any one of the first aspect to the fifth aspect, in which the stacking portion has a stacking surface inclined upward toward the downstream in the transport direction, and the recess portions have aligning surfaces orthogonal to the stacking surface.

Here, the "orthogonal" does not mean strict orthogonality, but is used to mean that there is a width within a range in which the deformed portion of the medium P can escape.

According to this aspect, since an aligning surface of the recess portion is orthogonal to the inclined stacking surface of the stacking portion, the rear end of them medium can be stably aligned using the aligning surface of the recess portion.

A processing device according to an eighth aspect of the present disclosure includes: a processing section that performs processing on a medium; a pair of medium supporting portions that are provided to face each other in a width direction intersecting a transport direction in which the medium is transported from the processing section, have support surfaces that support the medium, and support the transported medium by the support surfaces; a stacking portion which is provided vertically below the pair of medium supporting portions and on which the medium dropped from the pair of medium supporting portions is stacked; and a standing wall that aligns the medium by contacting a rear end of the medium in the transport direction supported by the pair of medium supporting portions, in which the support surfaces are inclined upward toward a downstream in the transport direction, and the standing wall includes: a center contacting wall that is provided in a center in the width direction and contacts the medium, and recess portions that are provided on both sides of the center contacting wall in the width direction and are recessed in a direction away from the support surfaces.

According to this aspect, the same effect as that of the first aspect can be obtained in the processing device.

A recording system according to a ninth aspect of the present disclosure includes: a recording device including a recording section that performs recording on a medium, and a discharge section that discharges the medium on which the recording is performed by the recording section; and a processing device including a medium introducing portion that introduces the medium discharged from the discharge section, a processing section that performs processing on the medium introduced from the medium introducing portion, a pair of medium supporting portions that are provided to face each other in a width direction intersecting a transport direction in which the medium is transported from the processing section, have support surfaces that support the medium, and support the transported medium by the support surfaces, a stacking portion which is provided vertically below the pair of medium supporting portions and on which the medium dropped from the pair of medium supporting portions is stacked, and a standing wall that aligns the medium by contacting a rear end of the medium in the transport direction supported by the pair of medium supporting portions, in which the support surfaces are inclined upward toward a downstream in the transport direction, and the standing wall includes: a center contacting wall that is provided in a center in the width direction and contacts the medium, and recess portions that are provided on both sides of the center contacting wall in the width direction and are recessed in a direction away from the support surfaces.

According to this aspect, the same effect as that of the first aspect can be obtained in the recording system including the recording device.

Embodiment

Hereinafter, embodiments of the present disclosure will be described in detail with reference to the accompanying drawings.

An XYZ coordinate system illustrated in each drawing is a rectangular coordinate system, and an X-axis direction is a width direction of a medium P and is also a depth direction of each device. A Y-axis direction is the length direction of the medium P when the medium P is transversely transported and is the width direction of each device. A Z-axis direction is a thickness direction or a stacking height direction when the medium P is transversely placed, and indicates a vertical direction or the height direction of each device.

Further, a Ya-axis direction indicates a transport direction or a sheet discharging direction in a processing device or a sheet discharging device of the present embodiment, and +Ya indicates a downstream when the medium P is transported or discharged. Further, −Ya indicates an upstream opposite to the above. In the present embodiment, the Ya-axis direction is set to a direction in which the +Ya side has an upward inclination which is slightly higher in the Z-axis direction than in the transverse Y-axis direction.

Overall Configuration of Recording System

First, based on FIGS. 1 to 4, an overall configuration of a recording system including the processing device having the sheet discharging device according to an embodiment of the present disclosure will be schematically described.

A recording system 1 according to the present embodiment includes a recording device 2 having a recording section 10 that performs recording on the medium P such as a printing sheet and a second discharge path 13 that is a discharge section that discharges the medium P recorded by the recording section 10.

Further, a recording system 1 includes a processing device 4 including a medium introducing portion 40 that introduces the medium P discharged from the second discharge path 13 that is a discharge section, a processing section 36 that performs processing on the medium P introduced from the medium introducing portion 40, a pair of medium supporting portions 50L and 50R that are provided to face each other in a width direction X intersecting a transport direction Ya in which the medium P is transported via the processing section 36, have support surfaces 50*a* that support the medium P, and support the transported medium P by the support surfaces 50*a*, an elevatable stacking portion 37 which is provided below the pair of medium supporting portions 50L and 50R in the vertical direction Z and on which the medium P dropped from the pair of medium supporting portions 50L and 50R is stacked, and a standing wall 140 (FIG. 2) that aligns the medium P by contacting a rear end 59 of the medium P supported by the pair of medium supporting portions 50L and 50R in the transport direction Ya. The support surface 50*a* is inclined upward toward the downstream +Y side in the transport direction Ya. A structure of the standing wall 140 will be described below.

In detail, in the present embodiment, the recording system 1 is configured as illustrated in FIG. 1 as an example, and includes the recording device 2, an intermediate device 3, and the processing device 4 having a sheet discharging device 30 described below according to the present embodiment, which are sequentially arranged from the right side to the left side of FIG. 1.

The recording device 2, the intermediate device 3, and the processing device 4 are connected to each other, and the medium P, which is supplied by the recording device 2 and on which recording is executed, is continuously transported and discharged until the medium P is introduced into the processing device 4 via the intermediate device 3 and is finally delivered to the stacking portion 37.

Hereinafter, a schematic configuration of each of the recording device 2, the intermediate device 3, and the processing device 4 will be described in this order.

Outline of Recording Device

The recording device 2 is configured as a compound machine including: a printer section 5 including a recording head (recording section) 10 that executes the recording by ejecting ink that is an example of liquid to a recording sheet that is an example of the medium P; and a scanner section 6 that reads an image on a document. In the present embodiment, the printer section 5 is configured as a so-called ink jet printer, and a line head that executes the recording in a width direction X of the medium P at once is adopted as an example of the recording head 10.

Further, a plurality of stages of medium accommodation cassettes 7 are provided at a lower portion of a main body of the recording device 2, and for example, a plurality of mediums P having different sizes are classified according to the size and are individually accommodated in these medium accommodation cassettes 7.

The medium P accommodated in the medium accommodation cassette 7 of each stage is sent to a recording area of the printer section 5 in which the recording head 10 exists through a supply path 11 indicated by a solid line in the recording device 2 of FIG. 1, and a desired recording operation is executed on the medium P. As an example, the medium P on which the recording is executed by the recording head 10 is supplied to either a first discharge path 12 in which the medium P is discharged toward a discharge tray 8 provided above the recording head 10 or a second discharge path 13 in which the medium P is discharged to the processing device 4 according to the present embodiment via the intermediate device 3, which will be described below.

Further, in FIG. 1, the first discharge path 12 is illustrated by a broken line, and the second discharge path 13 is illustrated by a dashed line.

Further, the printer section 5 of the recording device 2 also includes a reversing path 14 indicated by a two-dot chain line, and double-sided recording can be executed in which after the recording is executed on the front surface of the medium P, the medium P is reversed and the recording is continuously executed on the rear surface of the medium P.

Further, although not illustrated, one or more of transport roller pairs that apply a transport force to the medium P and a guide roller or a guide member that guides the transport of the medium P are appropriately arranged in each of the supply path 11, the first discharge path 12, the second discharge path 13, and the reversing path 14.

In addition, the recording device 2 is provided with: a manipulation panel that is not illustrated and is used when various pieces of information on the transport and the recording of the medium P are input; and a controller 15 that controls various operations related to the transport and the recording of the medium P based on the input various pieces of information.

Further, a structure in which the manipulation panel and the controller 15 are installed in each of the recording device 2, the intermediate device 3, and the processing device 4 may be provided or a structure in which the manipulation panel and the controller 15 are provided only in the recording device 2 to control the entire devices may be provided.

Outline of Intermediate Device

The intermediate device 3 is a device that receives, from the recording device 2, the medium P that has been recorded and is discharged through the second discharge path 13, and delivers the received medium P to the processing device 4.

The intermediate device 3 is provided with an intermediate reception path 20 indicated by a solid line in FIG. 1, through which the medium P that has been recorded and is discharged through the second discharge path 13 of the recording device 2 is received in a device body of the intermediate device 3.

Further, a branch portion 24 is provided at an end of the intermediate reception path 20, and two transport paths through which the medium P is transported with the branch portion 24 as a starting point are provided. Among them, a first transport path is a transport path from the intermediate reception path 20 via a first switchback path 21 to an intermediate discharge path 23.

Further, the first switchback path 21 is a path through which the medium P is received in an arrow A1 direction, is switched back in an arrow A2 direction, and then reaches the intermediate discharge path 23. A second switchback path 22 is a path through which the medium P is received in an arrow B1 direction, is switched back in an arrow B2 direction, and then reaches the intermediate discharge path 23.

Therefore, a merging section 25 is provided at ends of the first switchback path 21 and the second switchback path 22, and by the merging section 25, both the medium P sent to the first switchback path 21 and the medium P sent to the second switchback path 22 are led to the common intermediate discharge path 23, so that the medium P can be delivered to the processing device 4 having the sheet discharging device 30, which will be described below.

Further, although not illustrated, one or more transport roller pairs that apply a transport force to the medium and a guide roller or a guide member that guides the transport of the medium P are appropriately arranged in each of the intermediate reception path 20, the first switchback path 21, the second switchback path 22, and the intermediate discharge path 23.

Further, when the recording is continuously performed on a plurality of the mediums P, the medium P received in the intermediate device 3 can be alternately sent to a transport path passing through the first switchback path 21 and a transport path passing through the second switchback path 22. By the way, with such a configuration, the throughput of the transport of the medium P in the intermediate device 3 can increase, and efficient intermediate transport can be realized.

Further, when the medium P recorded by the recording device 2 is sent to the processing device 4 via the intermediate device 3, a transport time is long as compared to a case where the medium P is directly sent from the recording device 2 to the processing device 4. Thus, it is possible to promote drying of ink ejected and attached onto the front surface or the rear surface of the medium P before being transported to the processing device 4.

Further, when the promotion of the drying of the ink is not required, the recording system 1 may include only the recording device 2 and the processing device 4 while the intermediate device 3 is omitted.

Outline of Processing Device

The processing device 4 is a device that collects, into a bundle, a plurality of mediums P on which the recording is performed by the recording device 2 and of which the drying is promoted by the intermediate device 3, executes a predetermined process on the mediums P after aligning the mediums P, and sequentially discharges and stacks the mediums P in the stacking portion 37 by the sheet discharging device 30.

Accordingly, the processing device 4 is provided with: a transport element that leads and aligns the medium P delivered from the intermediate device 3 into a main body of the processing device 4 and transports the medium P for discharging the medium P; an aligning element that collects and aligns the plurality of transported mediums P into a bundle; a processing element that executes a predetermined process such as a stapling process on the aligned mediums P; and a discharging/stacking element that discharges the processed mediums P and sequentially stacks the mediums P.

In the present embodiment, the transport element includes a transport path 31, a first transport roller pair 32, a second transport roller pair 33, a medium transport section 34, and a medium placement section 35. Further, the aligning element includes a rear end aligning section 38, a paddle mechanism 43 (FIG. 3), and a side end aligning section 41. The processing element includes the processing section 36 that performs a stapling process, a punching process, a folding process, and a saddle stitching process. The discharging/stacking element includes the sheet discharging device 30, the medium supporting portion 50, the standing wall 140, and the stacking portion 37.

Further, in the present embodiment, a pressing element is provided which suppresses the occurrence or the like of lateral curl which is generated by the transport and in which a front end 56 of the medium P is bent upward, vertical curl in which left and right side ends 57L and 57R of a tip portion 53 of the medium P are bent upward, and curl in which a central portion of the medium P is expanded upward due to swelling by the ink. The pressing element includes a pressing section 51 and the medium supporting portion 50.

Further, the medium introducing portion 40 of the processing device 4 is provided with the transport path 31 that guides the medium P delivered to the processing device 4 into a device body such that the medium P can be transported in a predetermined manner. Further, two transport roller pairs including the first transport roller pair 32 and the second transport roller pair 33 that apply a transport force to the medium P introduced into the device body are provided as an example on the transport path 31.

Hereinafter, a detailed configuration of the processing device 4 according to the present embodiment, configured by these respective elements, will be described in detail.

Detailed Configuration of Processing Device

As illustrated in FIGS. 1 to 4, a processing device 4 according to the present embodiment includes: a processing section 36 that performs processing on a medium P; a pair of movable medium supporting portions 50L and 50R that are provided to face each other in a medium width direction X intersecting a transport direction Ya in which the medium P is transported via the processing section 36, have support surfaces 50*a* that support the medium P, and support the outside of the center of the transported medium P in the width direction X; a stacking portion 37 which is provided below the pair of medium supporting portions 50L and 50R in the vertical direction Z and on which the medium P dropped from the pair of medium supporting portions 50L and 50R is stacked.

The pair of medium supporting portions 50L and 50R have inclined portions 130 inclined downward toward the center of at least parts of the support surfaces 50*a* in the medium width direction X.

Further, as illustrated in FIGS. 1 to 5, in the present embodiment, the pressing section 51 is provided which has a pressing surface 51*a* facing a support surface 50*a* of the medium supporting portion 50 and in which the pressing surface 51*a* is movable between a retraction position Q1 and a pressed position Q2 where the pressing surface 51*a* is closer to the support surface 50*a* than the retraction position Q1. The pressing section 51 is configured to be located in the retraction position Q1 when the medium P is transported to the medium supporting portion 50 and to be located in the pressed position Q2 after the aligning section 38 aligns the medium P on the medium supporting portion 50.

Figure 2:
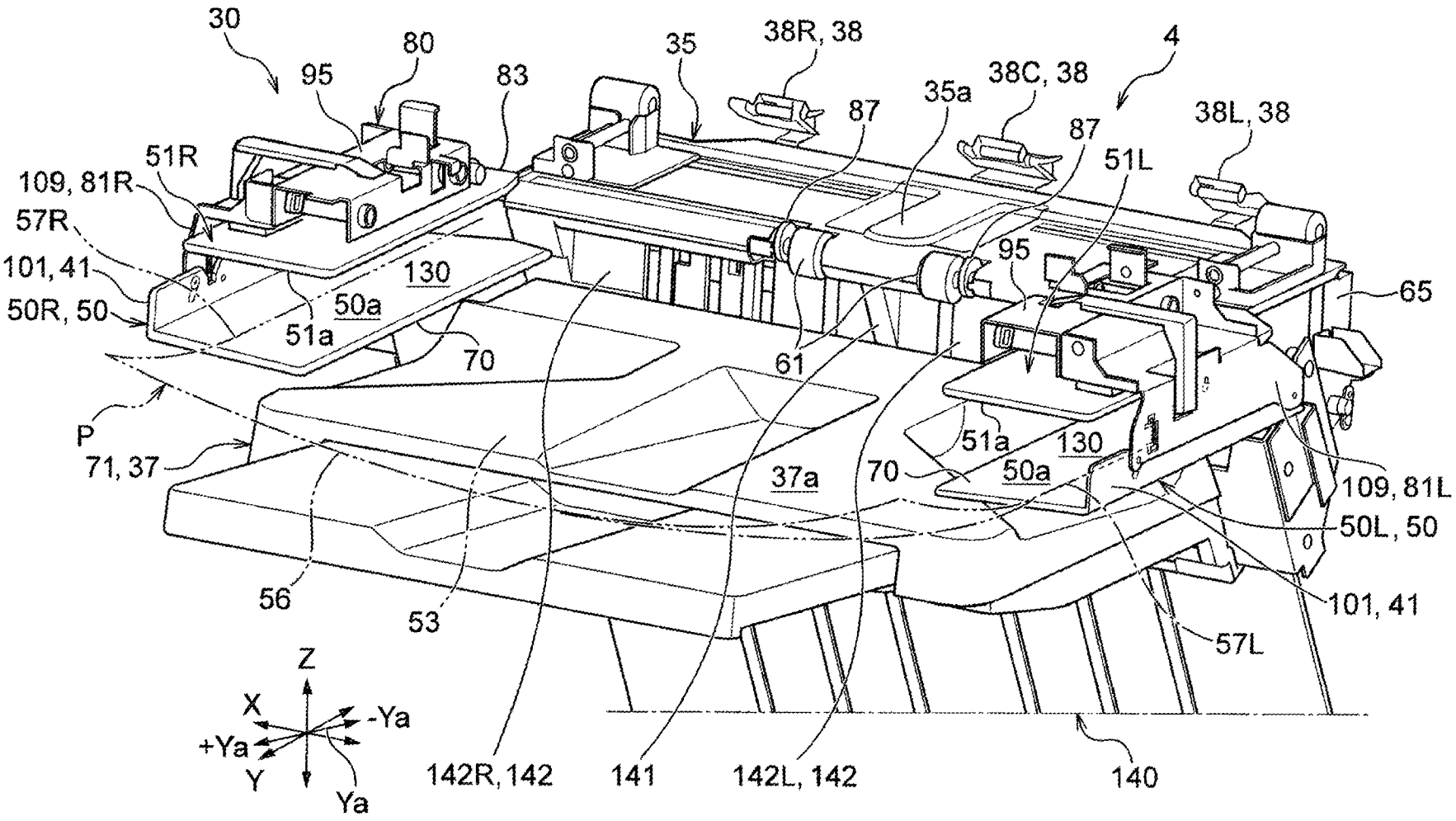
FIG. 2 is a perspective view illustrating a processing device according to the present embodiment.
Figure 3:
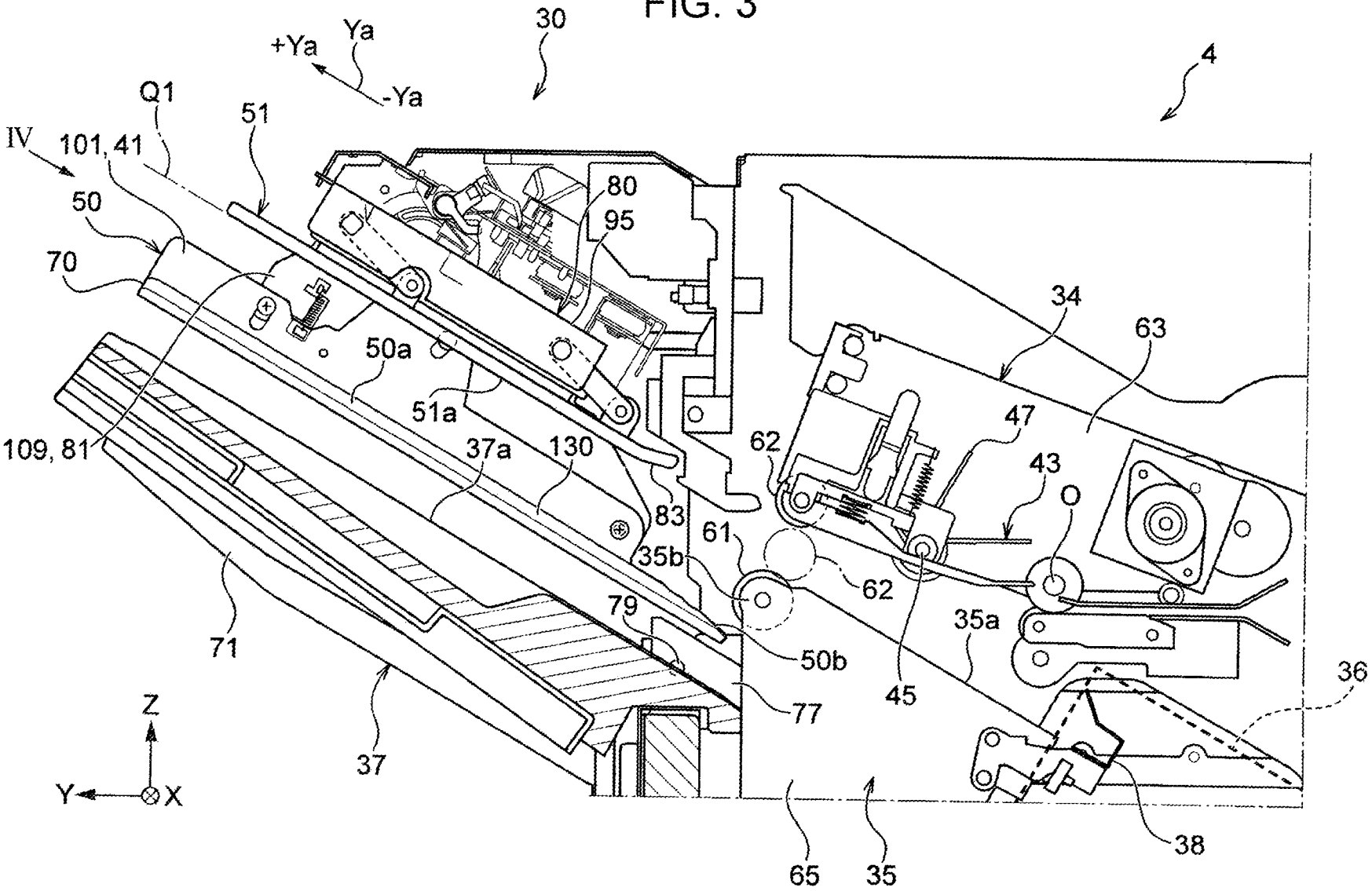
FIG. 3 is a side sectional view illustrating the same processing device before receiving a medium.
Figure 4:
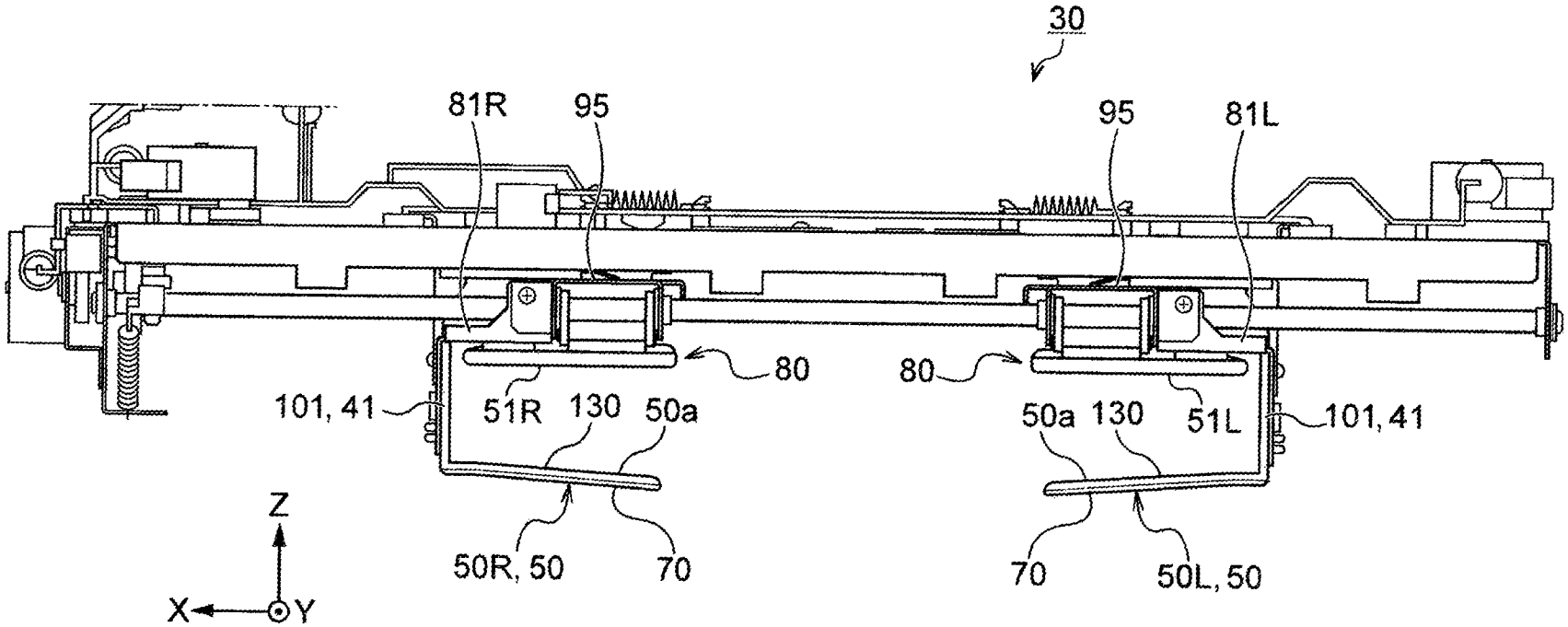
FIG. 4 is a view on arrow IV in FIG. 3 illustrating a medium supporting portion of the same processing device.
Figure 5:
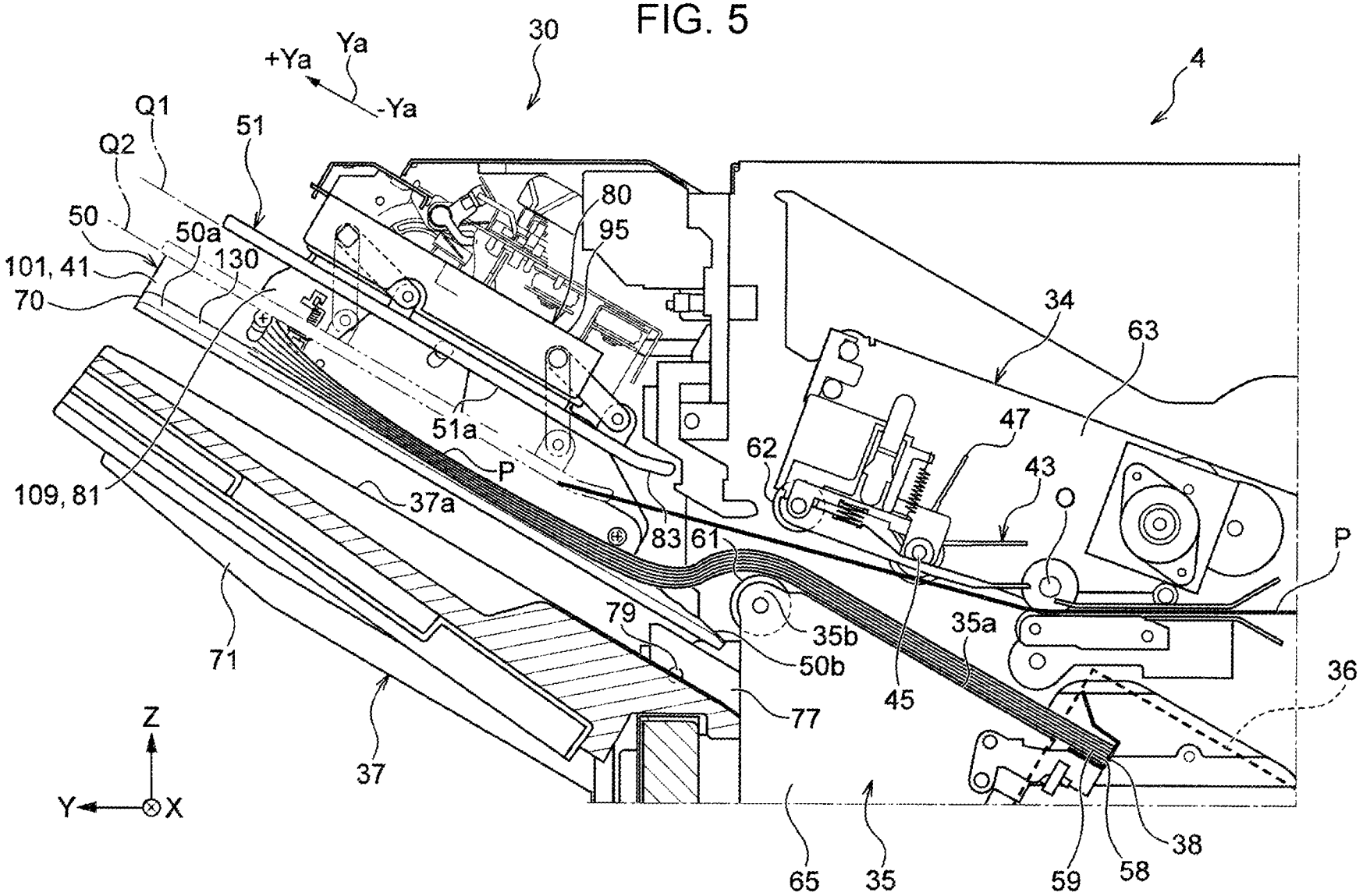
FIG. 5 is a side sectional view illustrating the processing device according to the present embodiment when receiving the medium.

Further, as illustrated in FIGS. 2 and 3, in the present embodiment, the medium placement section 35 having a placement surface 35*a* that can support a portion of the medium P transported from the intermediate device 3 on the rear end 59 side is provided at a −Ya position upstream of the medium supporting portion 50 in the transport direction Ya. Further, the medium transport section 34 including the paddle mechanism 43 that assists an operation of the aligning section 38 is provided above the medium placement section 35.

Further, the medium supporting portion 50 and the stacking portion 37 stack and hold the medium P discharged after being aligned and processed, and may thus be constituent members of the sheet discharging device 30. Hereinafter, constituent members of the above-described respective elements constituting the processing device 4 will be described in detail.

Transport Element

As illustrated in FIGS. 1 and 3, the transport element of the processing device 4 includes the transport path 31, the first transport roller pair 32, the second transport roller pair 33, the medium transport section 34, and the medium placement section 35.

In the present embodiment, as illustrated in FIG. 1, the transport path 31 is a transport path 31 which is disposed in the medium introducing portion 40 transversely in parallel to the Y-axis direction, is corrected upward from a portion where the medium transport section 34 and the medium placement section 35 are arranged, and is upwardly inclined along the transport direction Ya.

A first transport roller pair 32 including a pair of nip rollers is provided upstream (in the −Y direction) of a transverse portion of the transport path 31, and in the same manner, a second transport roller pair 33 including a pair of nip rollers is provided downstream (in the +Y direction) of the transverse portion.

The medium transport section 34 is a section that transports the bundle of the mediums P, which have been aligned and processed, from a position where a portion on the rear end 59 side exists on the placement surface 35*a* of the medium placement section 35 to a position where the portion on the rear end 59 side is located on the support surface 50*a* of the medium supporting portion 50.

The medium transport section 34 includes a swinging frame 63 that swings about a swinging supporting point O at a predetermined angle, and a transport driven roller 62 that is in contact with the upper surface of the bundle of the medium P and applies, to the medium P, a transport force to the downstream +Ya of the transport direction Ya by a nip operation between the transport driven roller 62 and a transport driving roller 61, which will be described below, is provided in a corner portion downstream of the lower surface of the swinging frame 63. Further, the paddle mechanism 43 for assisting the aligning, which will be described below, is also mounted on the medium transport section 34.

Further, a transport section that uses a transport belt bridged over by a plurality of rollers arranged in a loop shape or the like instead of the above-described set of the transport driving roller 61 and the transport driven roller 62 and further together uses a suction adsorption-type or electrostatic adsorption-type adsorption section using a negative pressure generated by a suction fan may be adopted as the medium transport section 34.

The medium placement section 35 is a member that supports the portion of the medium P on the rear end 59 side led to the transport path 31 and assists smooth execution of an aligning work.

The medium placement section 35 has a housing 65 formed on the upper surface thereof and having the placement surface 35*a* inclined along a sheet discharging direction Ya. The transport driving roller 61, which constitutes a nip roller together with the transport driven roller 62 and applies a transport force to the medium P, is installed at the corner portion of an upper portion of the housing 65 at a downstream position. In addition, a motor that is not illustrated and applies a driving force to the transport driving roller 61, a power transmission section, and a movement section that moves the aligning section 38, which will be described below, to the downstream +Ya or the upstream −Ya in the sheet discharging direction Ya in which the medium supporting portion 50 exists are provided in the housing 65.

Aligning Element

As illustrated in FIGS. 1 to 5, the aligning element of the processing device 4 includes the rear end aligning section 38, a first side end aligning section that is not illustrated, the paddle mechanism 43, and the second side end aligning section 41. Further, the support surface 50*a* of the medium supporting portion 50 and the placement surface 35*a* of the medium placement section 35 exist as portions that support the medium P from below when the medium P is aligned.

The rear end aligning section 38 is a section that arranges and aligns the rear end 59 of the bundle of the plurality of mediums P supported by the placement surface 35*a* of the medium placement section 35. The rear end aligning section 38 is a member having an open end surface on the downstream +Ya side in the sheet discharging direction Ya and having a substantially U-shaped cross section. In the present embodiment, the rear end aligning section 38 is provided with three pairs of rear end aligning section 38L, 38R, and 38C arranged on left and right sides and a central side in the medium width direction X, respectively (FIG. 2).

The pair of left and right first side end aligning sections are provided and right to pinch the medium P on the medium placement section 35 from the medium width direction X, and is configured to be able to perform a predetermined stroke and shift operation in the medium width direction X. Accordingly, the side edge of the medium P, which is supported by the placement surface 35*a* of the medium placement section 35, on the rear end 59 side can be aligned.

Further, the support surface 50*a* of the medium supporting portion 50 and the placement surface 35*a* of the medium placement section 35 are inclined surfaces that assist the rear end 59 of the medium P smoothly entering and being held in the rear end aligning section 38. The medium P slides down the support surface 50*a* and the placement surface 35*a* that are inclined surfaces by its own weight, and the rear end 59 of the medium P is smoothly led into the rear end aligning section 38 and comes into contact with the rear end aligning section 38, so that the medium P is arranged and aligned.

Further, the paddle mechanism 43 exists as a mechanism for assisting the movement of the medium P by its own weight.

The paddle mechanism 43 includes a rotary shaft 45 extending in the medium width direction X, a plurality of blades called paddles 47, which are provided around the rotary shaft 45 and are made of rubber, and a driving section that rotationally drives the rotary shaft 45 in a direction in which the rear end 59 of the medium P enters the rear end aligning section 38. Further, two sets of the paddles 47 configured by the plurality of blades are arranged at positions spaced apart from each other in the medium width direction X, and are provided to be movable in the medium width direction X.

The first side end aligning section and the second side end aligning section 41 are arranged on left and right sides of the medium transport section 34 and the medium placement section 35 to pinch the medium transport section 34 and the medium placement section 35. The both aligning sections arrange and align left and right side ends 57L and 57R of the bundle of the mediums P by performing the predetermined stroke and shift operation in the medium width direction X by a shift mechanism that is not illustrated.

Further, the second side end aligning section 41 is a member that constitutes the medium supporting portion 50 as will be described below. A pair of left and right medium supporting portions 50 are provided to pinch the medium P in the medium width direction X, and are configured to be able to perform the predetermined stroke and shift operation in the medium width direction X by a shift mechanism that is not illustrated. Accordingly, the side ends 57L and 57R (FIG. 2) which are mainly side edges of the tip portion 53 of the medium P supported by the support surface 50*a* of the medium supporting portion 50 are aligned with each other.

Processing Element

The processing element of the processing device 4 includes the processing section 36 that executes a predetermined process on the medium P placed on the medium placement section 35.

The processing sections 36 illustrated in FIGS. 1 and 3 are provided as an example at three points including left and right corner portions and a central portion of the medium P at the rear end 59, and as described above, a predetermined process such as the stapling process, the punching process, the folding process, and the saddle stitching process is executed.

In the present embodiment, a configuration in which the stapling process is performed by driving a stapling needle that is not illustrated into one of the above-described three points of the medium P at the rear end 59 is adopted as an example. Accordingly, the processing section 36 is appropriately provided with an accommodation section that can accommodate a plurality of stapling needles, a mechanism that sends the stapling needles to a stapling position, and a mechanism that drives the stapling needles.

Discharging/Stacking Element

The discharging/stacking element of the processing device 4 includes the sheet discharging device 30 of the present disclosure, that is, the medium supporting portion 50, the standing wall 140, and the stacking portion 37 that are constituent members thereof.

The sheet discharging device 30 basically executes: a sheet discharging operation (FIG. 6) of transferring, to the downstream +Ya in the sheet discharging direction Ya, the bundle of the mediums P having the portion on the rear end 59 side supported by the placement surface 35*a* of the medium placement section 35 and processed by the processing section 36, and positioning the rear end 59 side of the medium P onto the support surface 50*a* of the medium supporting portion 50; and a stacking operation (FIG. 10) of stacking, on the stacking surface 37*a* of the stacking portion 37 below the mediums P, the bundle of the mediums P discharged after the support by the medium supporting portion 50 is released.

The medium supporting portion 50 is a medium support member in which a lower support section 70 having an upper surface serving as the support surface 50*a* and a side plate 101 having an inner wall surface serving as a regulation surface when the side ends 57L and 57R (FIG. 2) of the medium P are aligned with each other are integrally formed, and which has, for example, an L-shaped cross-sectional shape. The medium supporting portion 50 is provided in an inclined posture having an upward inclination in which the downstream +Ya side along the sheet discharging direction Ya is higher. The side plate 101 also functions as the second side end aligning section 41.

The medium supporting portions 50 are arranged to face each other on the left and right sides in the medium width direction X, and are configured to be able to perform a shift operation of a predetermined stroke in the medium width direction X as an example. In detail, in a state in which the medium P is supported, the left and right medium supporting portions 50L and 50R are both shifted inward to support the lower surface of the medium P near the side ends 57L and 57R.

On the other hand, when the support of the medium P is released and the bundle of the mediums P are dropped onto the stacking surface 37*a* of the stacking portion 37 therebelow, both the left and right medium supporting portions 50L and 50R are configured to be shifted outward and to be moved to the outside of an area where the medium P exists.

The stacking portion 37 includes an elevatable sheet discharging tray 71 that receives the bundle of the medium P dropped downward in the vertical direction Z as the support by the medium supporting portion 50 is released.

As illustrated in FIG. 3, the sheet discharging tray 71 has the stacking surface 37*a* provided in an inclined posture having an upward inclination in which the downstream +Ya side along the sheet discharging direction Ya is higher, which is like the medium supporting portion 50. In a state in which the sheet discharging tray 71 is located at the uppermost position illustrated in FIG. 3, the sheet discharging tray 71 is configured to always maintain a constant distance between the stacking surface 37*a* and the medium supporting portion 50 and to stand by at a lower position thereof.

Further, a sensor 79 is provided in a housing 77 on a side of a base portion of the sheet discharging tray 71 when the sheet discharging tray 71 is located at the uppermost position. In many cases, when the bundle of the mediums P are dropped onto the stacking surface 37*a* of the sheet discharging tray 71, the sensor 79 detects the presence of the medium P, and the sheet discharging tray 71 is configured to move downward in the vertical direction Z by a stacking height of the bundle of the medium P that has been dropped. Accordingly, when the support by the medium supporting portion 50 is released and the bundle of the mediums P are dropped, the dropping distance is maintained substantially constant.

Pressing Element

As illustrated in FIGS. 2 to 5, the pressing element of the processing device 4 includes: the pressing section 51 that is provided above the medium supporting portion 50 in an inclined posture having an upward indication in which the downstream +Ya side along the sheet discharging direction Ya is higher, which is like the medium supporting portion 50; a pressing mechanism 80 that presses the pressing section 51 against the medium supporting portion 50 side; and holding frames 81L and 81R (FIGS. 2 and 4) that have side plates 109 configured to hold the pressing section 51 and the pressing mechanism 80 while being connected to the medium supporting portion 50 and are bent in an L shape as an example.

The pressing section 51 is a flat plate-like member that is disposed in parallel with the medium supporting portion 50 and is slightly smaller than the lower support section 70 of the medium supporting portion 50, and an inclined guide 83 that is bent upward such that the medium P is smoothly transported and discharged is formed at the upstream −Ya in the sheet discharging direction Ya.

Further, connection pieces that are upwardly raised are provided at a downstream +Ya side position near the inclined guide 83 of the pressing section 51 and at a further downstream +Ya side position separated by a predetermined distance. The pressing section 51 is connected to the pressing mechanism 80 via these connection pieces.

The pressing mechanism 80 includes: a motor that is not illustrated and serves as a drive source; a power transmission mechanism that is not illustrated and transmits rotation of an output shaft of the motor to the drive shaft; and a power conversion mechanism that converts the rotation of the drive shaft into an approaching and separating operation of the pressing section 51 with respect to the support surface 50*a* of the medium supporting portion 50. Incidentally, in the present embodiment, a parallel link mechanism is adopted as the power conversion mechanism, and the power conversion mechanism is also provided in the gate-shaped support frame 95 as an example for supporting the motor that is not illustrated and the power transmission mechanism.

Detailed Configuration of Sheet Discharging Device (FIGS. 6 to 11)

A sheet discharging device 30 according to the present embodiment includes: a pair of medium supporting portions 50L and 50R that are provided to face each other in a width direction X intersecting a transport direction Ya in which a medium P is transported, have support surfaces 50*a* that support the medium P, and support the transported medium P by the support surfaces 50*a*; an elevatable stacking portion 37 which is provided vertically below the pair of medium supporting portions 50L and 50R and on which the medium P dropped from the pair of medium supporting portions 50L and 50R is stacked; and a standing wall 140 that aligns the medium P by contacting a rear end 59 of the medium P supported by the pair of medium supporting portions 50L and 50R in the transport direction Ya.

The support surface 50*a* is inclined upward toward the downstream +Ya side in the transport direction Ya.

Since a basic configuration of the medium supporting portion 50 and the like has already been described, a structure of the standing wall 140 of the sheet discharging device 30 according to the present embodiment will be described herein.

Standing Wall, Center Contacting Wall, and Recess Portion

As illustrated in FIG. 2 and FIGS. 6 to 10, the standing wall 140 is provided with a center contacting wall 141 at the center of the standing wall 140 in the width direction X. The center contacting wall 141 is provided at a position where the center contacting wall 141 is in contact with an edge 58 of the rear end 59 of the medium P supported by the support surfaces 50*a* of the pair of medium supporting portions 50L and 50R.

The standing wall 140 is further provided with recess portions 142 on both sides of the center contacting wall 141 in the width direction X, and the recess portions 142 have a structure recessed in a direction −Ya away from the support surfaces 50*a*.

Figure 8:
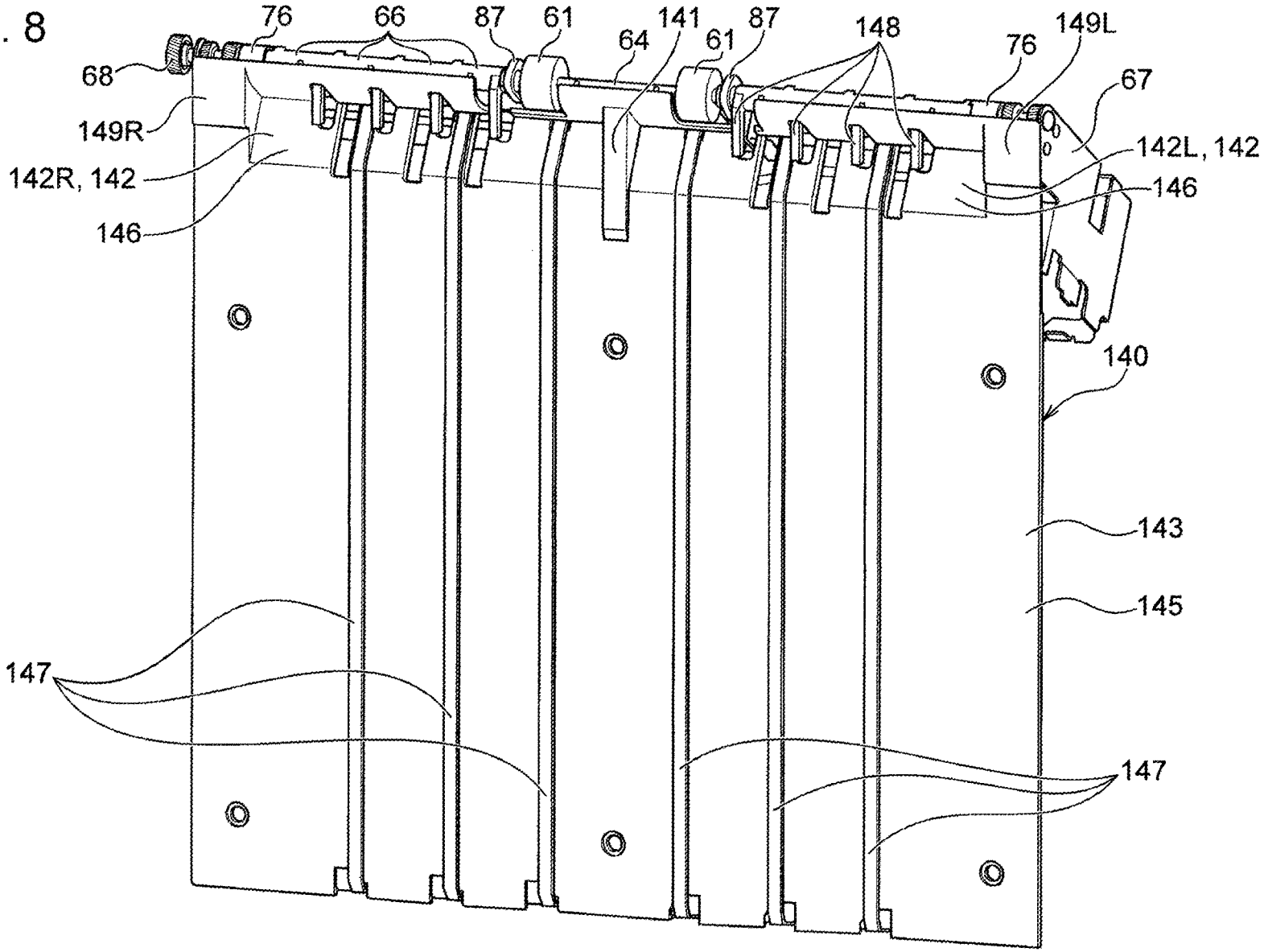
FIG. 8 is a perspective view illustrating the entire standing wall portion in the state of FIG. 6.

The center contacting wall 141 and the recess portions 142 are provided at the upper edge portion of a substantially quadrangular base plate 143 (FIG. 8).

Further, the number of the center contacting wall 141 is not limited to one, and may be two or more. When there are two or more center contacting walls 141, the recess portions 142 are provided outside the outermost one of the center contacting walls 141 in the width direction X.

Figure 7:
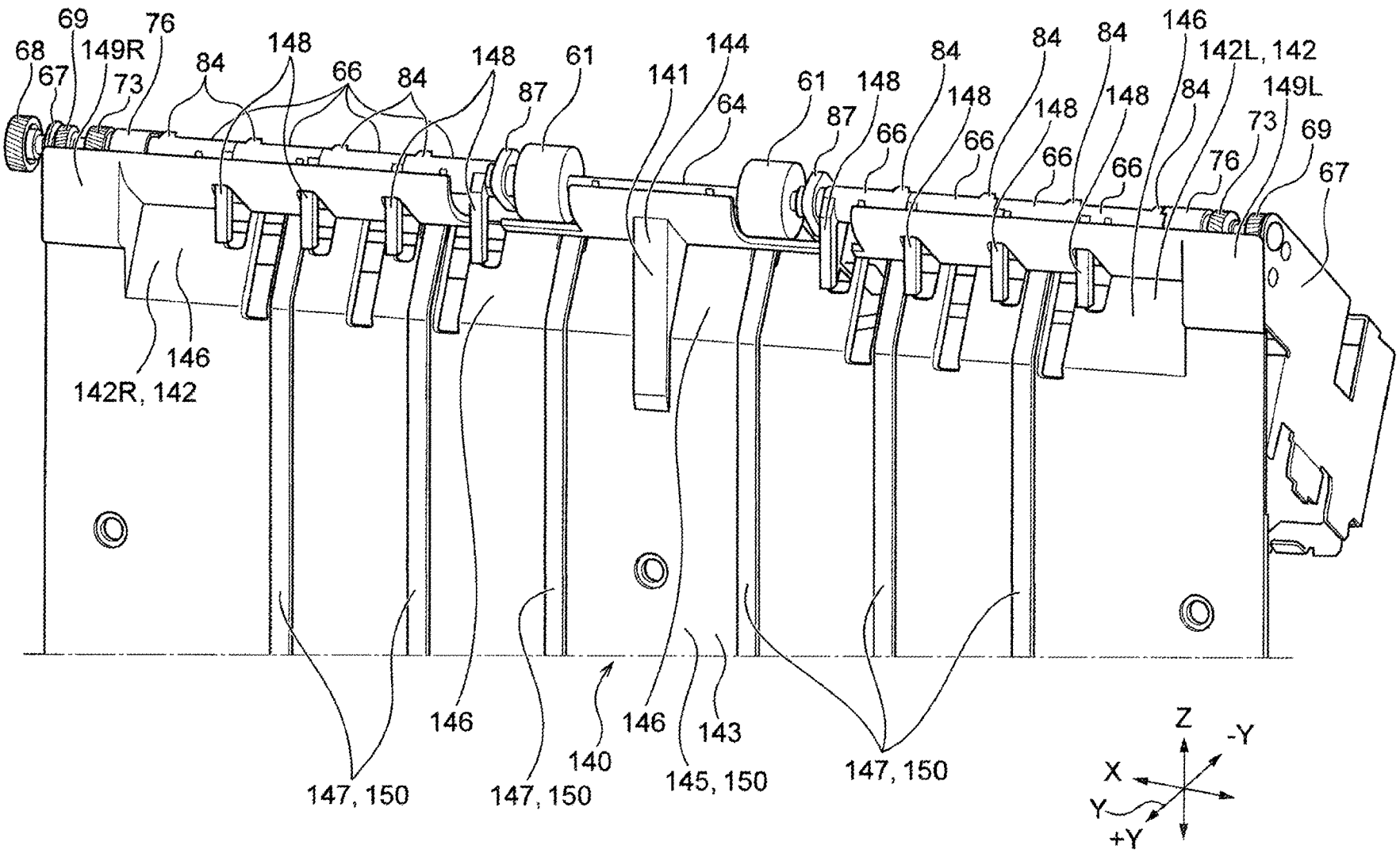
FIG. 7 is a perspective view illustrating a recess portion side of a standing wall portion in the state of FIG. 6.

In the present embodiment, the pair of medium supporting portions 50L and 50R are movable in the width direction X as described above. The center contacting wall 141 is configured to guide the medium P to the stacking portion 37 when the pair of medium supporting portions 50L and 50R move in directions away from each other, and the medium P is thus dropped. In detail, as illustrated in FIGS. 7 and 8, a contact surface 144 of the center contacting wall 141 that comes into contact with the medium P has a vertically long planar shape, so that the center contacting wall 141 can perform the guide.

The contact surface 144 is parallel to a base surface 145 of the base plate 143. The contact surface 144 and the base surface 145 are substantially the same surface, but in the present embodiment, the contact surface 144 slightly protrudes from the base surface 145.

Figure 6:
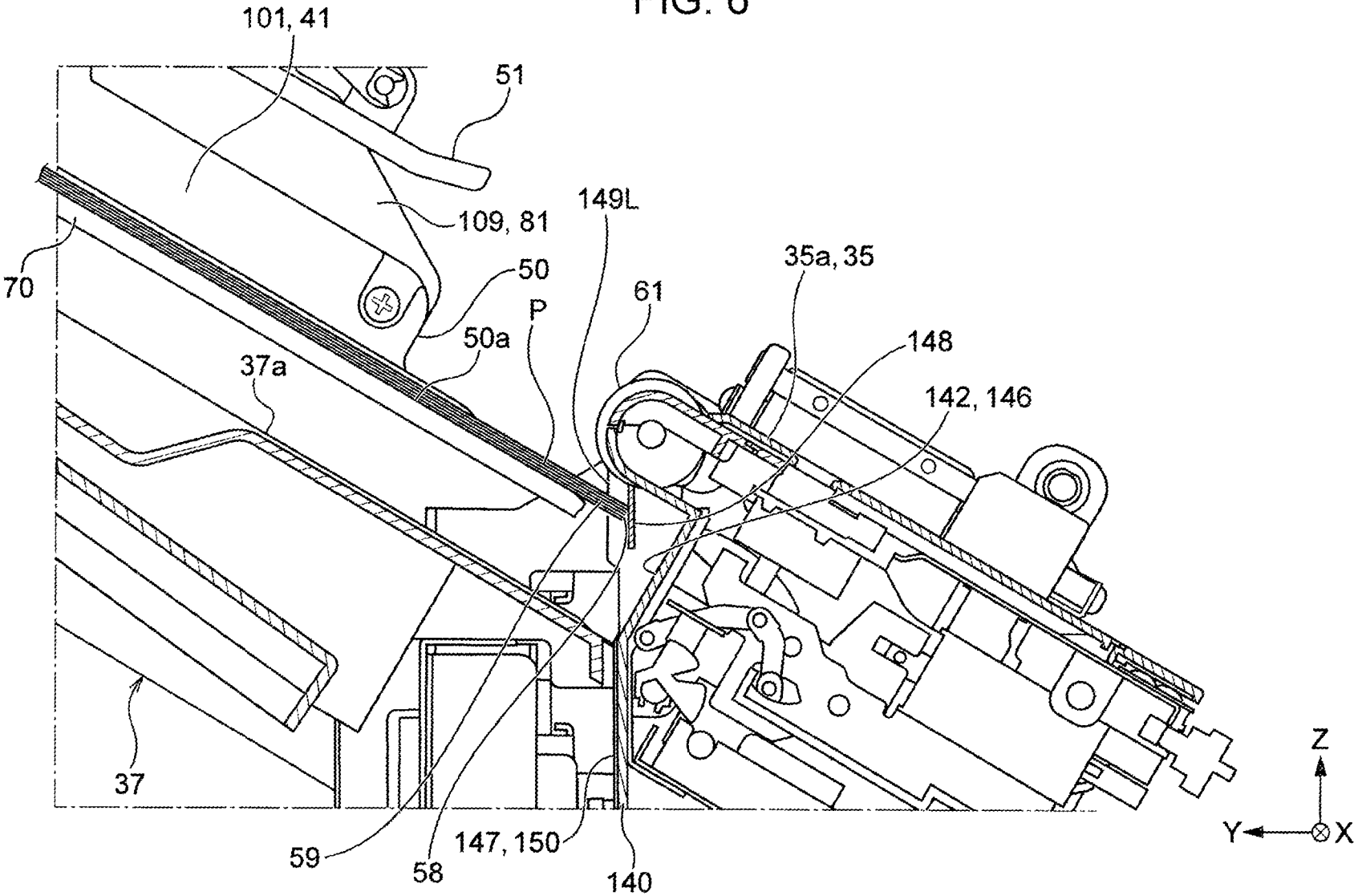
FIG. 6 is a side sectional view illustrating a state in which the medium is supported by the medium supporting portion and a standing wall of the same processing device.

In the present embodiment, in the recess portion 142, an aligning surface 146 facing the upstream −Ya side in the transport direction Ya is formed over the substantially entire region at an upper edge of the base surface 145 of the base plate 143, that is, in a region excluding both end portions 149L and 149R of the upper edge in the width direction X, so that a recess constituting the recess portion 142 is formed. Therefore, the recess portion 142 has a triangular shape in a side view, that is, when viewed from an X-axis direction (FIG. 6).

The recess portions 142 are symmetrically arranged as recess portions 142L and 142R having the same structure on both sides of the center contacting wall 141.

A plurality of low friction tapes 147 made of a material having a smaller friction coefficient than that of the base surface 145 are provided on the base surface 145 of the base plate 143. The low friction tape 147 is provided to slightly protrude from the base surface 145. Due to this protrusion structure, the edge 58 of the rear end 59 of the medium P is configured to contact the low friction tape 147 and slide in the vertical direction (Z direction).

In the present embodiment, the low friction tape 147 is also extended to the aligning surface 146 in the recess portion 142.

The transport driving roller 61 is disposed at the upper end portion of the standing wall 140. The transport driving roller 61 is supported by a roller shaft 64 and is rotated integrally with the roller shaft 64. Both ends of the roller shaft 64 are rotatably supported by a frame 67.

The medium P discharged by the transport driving roller 61 and the transport driven roller 62 as described above is supported on the support surfaces 50*a* of the pair of medium supporting portions 50L and 50R as illustrated in FIG. 6, and in this state, the edge 58 of the rear end 59 of medium P is aligned while contacting the standing wall 140.

In the present embodiment, a plurality of, in this case, four prism-shaped receiving portions 148 on each side, that is, totally eight prism-shaped receiving portions 148 are provided to be movable between a protrusion position (FIGS. 6 to 8) where the receiving portions 148 protrude inward from the recess portions 142L and 142R on both sides of the center contacting wall 141 and a retraction position (FIGS. 10 and 11) where the receiving portions 148 are retracted inward from the recess portions 142L and 142R.

As illustrated in FIG. 6, the plurality of receiving portions 148 come into contact with the edge 58 of the rear end 59 of the medium P supported by the support surface 50*a* in a state in which the receiving portions 148 are moved to the protrusion position, and align the medium P together with the center contacting wall 141.

Figure 10:
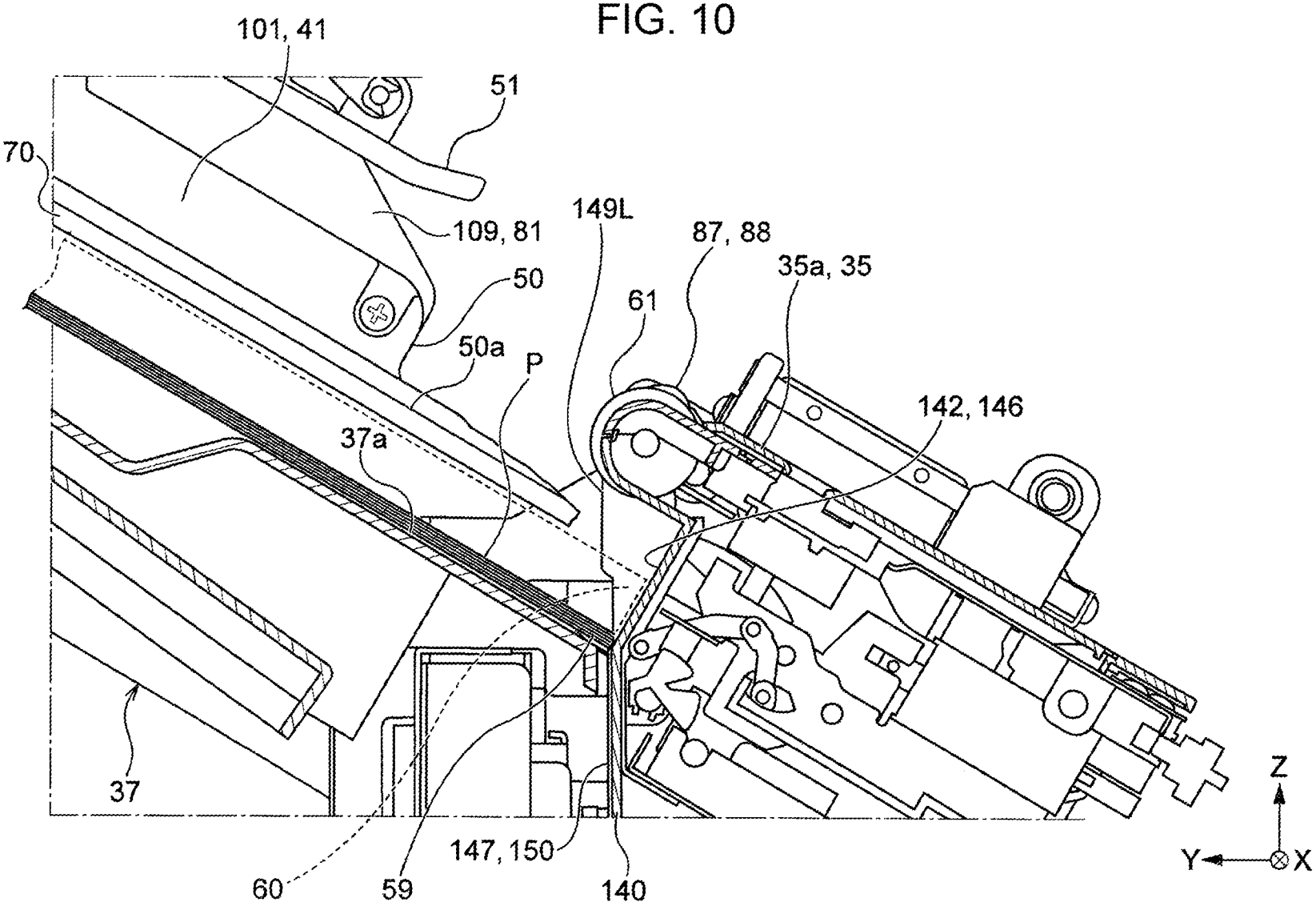
FIG. 10 is a side sectional view illustrating a moment at which the medium is dropped from the medium supporting portion of the same processing device onto a stacking portion.
Figure 11:
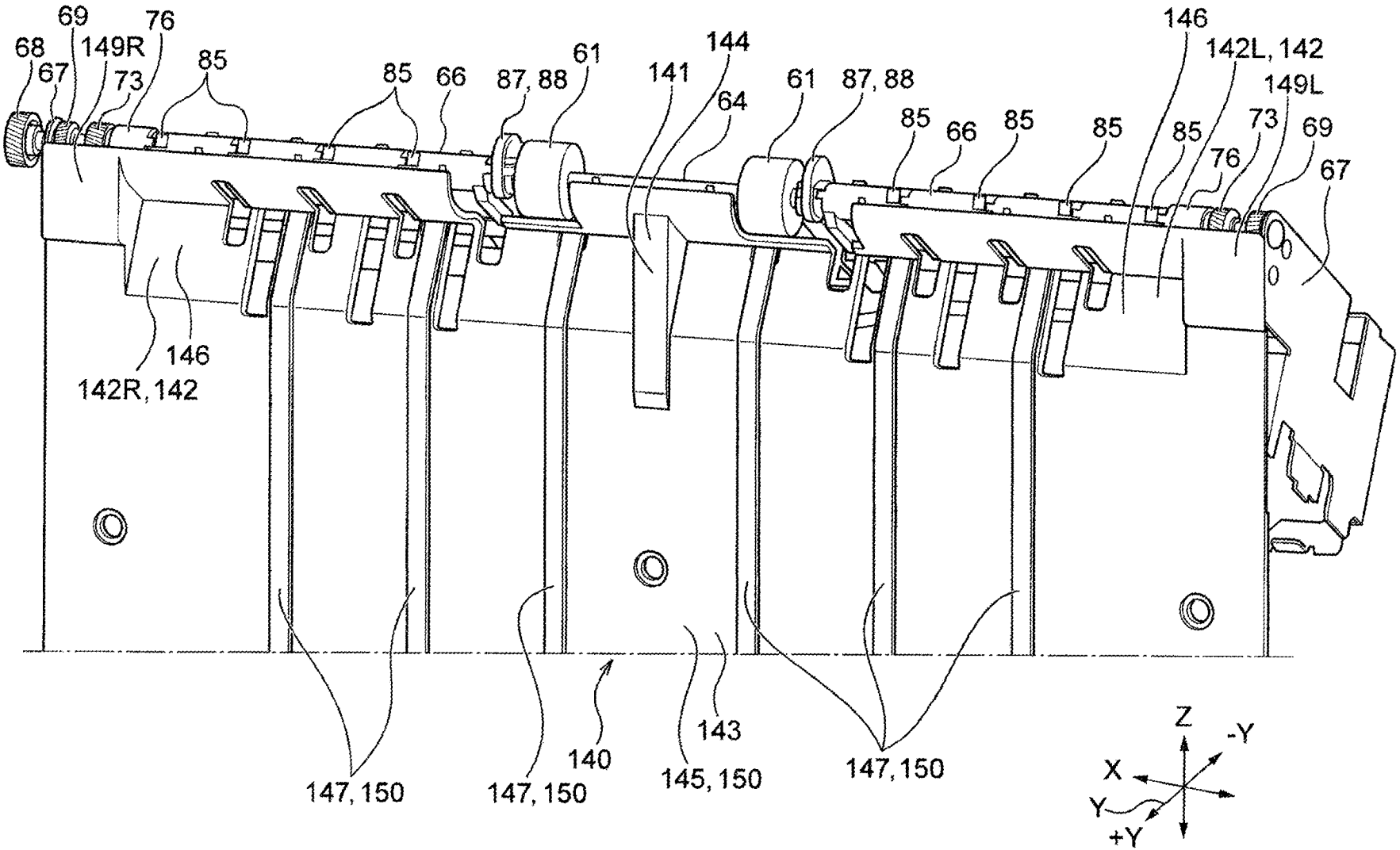
FIG. 11 is a perspective view illustrating the recess portion side of the standing wall portion in the state of FIG. 10.

When the medium P is dropped from the pair of medium supporting portions 50L and 50R onto the stacking portion 37, the plurality of receiving portions 148 are configured to move to the retraction position (FIGS. 10 and 11).

Mechanism for Moving Receiving Portion to Protrusion Position and Retraction Position As illustrated in FIG. 6 and FIGS. 9A, 9B, and 9C, four cylindrical bodies 66 on each side, that is, totally eight cylindrical bodies 66, are attached to the roller shaft 64. The cylindrical bodies 66 are relatively rotatably attached to the roller shaft 64. Further, the four cylindrical bodies 66 are connected to each other such that the adjacent ones engage with each other and rotate integrally.

In the present embodiment, the receiving portion 148 is provided in each of the cylindrical bodies 66. In detail, as illustrated in FIG. 7, the receiving portion 148 is provided to protrude from each cylindrical body 66 in the same tangential direction. As the cylindrical body 66 rotates about the roller shaft 64, the receiving portion 148 can move between the protrusion position and the retraction position.

Figure 9A:
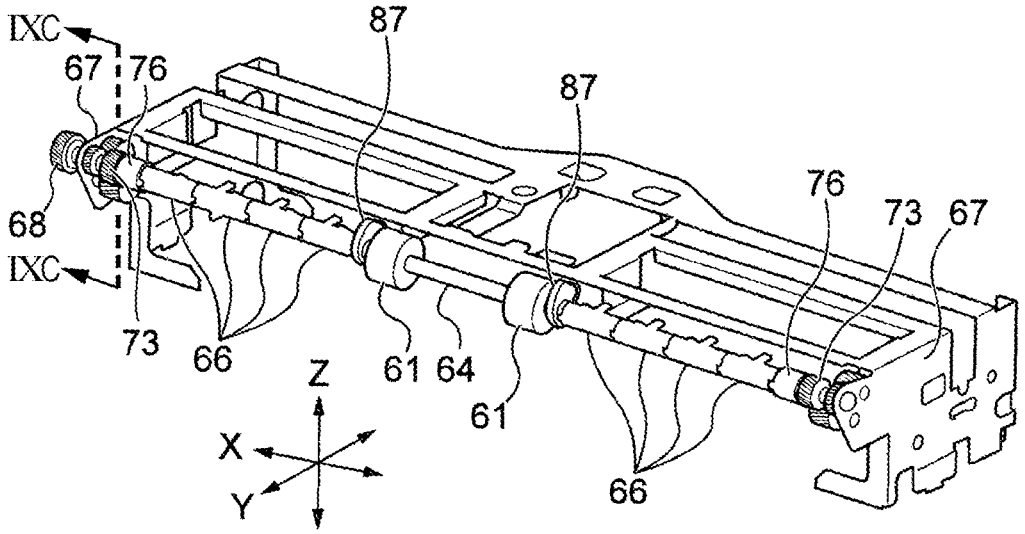
Figure 9B:
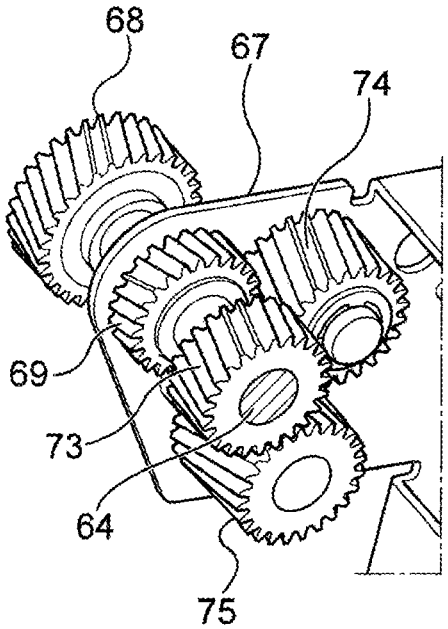
Figure 9C:
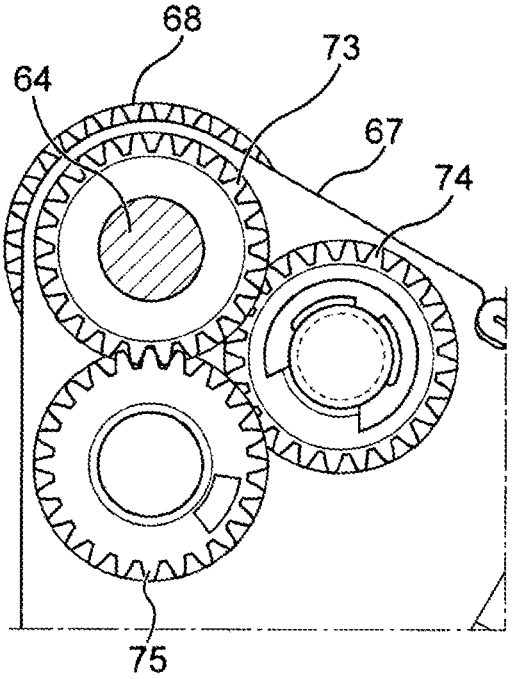

Power transmission for rotation of the cylindrical body 66 is configured as follows (FIGS. 9A to 9C).

A first driving gear 68 is attached to one end of the roller shaft 64 and outside the frame 67. The first driving gear 68 is rotated by power transmitted from a motor that is not illustrated and is a drive source, and accordingly, the roller shaft 64 and the transport driving roller 61 are also rotated integrally. A transmission gear 69 is attached to a position inside the frame 67 of the roller shaft 64 so as to rotate integrally with the roller shaft 64. A second driving gear 73 is relatively rotatably attached to the roller shaft 64 at a position slightly apart from the transmission gear 69 of the roller shaft 64. The second driving gear 73 is configured such that a rotational force of the transmission gear 69 is transmitted via a first intermediate gear 74 and a second intermediate gear 75 attached to the frame 67.

The rotation (forward rotation direction) of the transmission gear 69 that rotates integrally with the roller shaft 64 is transmitted to the first intermediate gear 74. The rotation (reverse rotation direction) of the first intermediate gear 74 is transmitted to the second intermediate gear 75. The rotation (forward rotation direction) of the second intermediate gear 75 is transmitted to the second driving gear 73. The second driving gear 73 rotates in the reverse rotation direction. That is, when the roller shaft 64 and the transport driving roller 61 rotate forwardly, the second driving gear 73 rotates in an opposite direction.

The transmission gear 69, the first intermediate gear 74, the second intermediate gear 75, and the second driving gear 73 are attached to an end of the roller shaft 64 opposite to a side on which the first driving gear 68 is attached.

The cylindrical body 66 is connected to the second driving gear 73 by a torque limiter 76, and is configured to rotate integrally with the second driving gear 73. When a load of a certain amount or more is applied to the cylindrical body 66, the torque limiter 76 stops the rotation of the cylindrical body 66 even when the roller shaft 64 continues to rotate.

A stopper 84 (FIG. 7) and another stopper 85 (FIG. 11) protrude from the outer surface of the cylindrical body 66 in circumferentially offset arrangement.

The one stopper 84 is for stopping the receiving portion 148 at the protrusion position (FIGS. 6 to 8). When the receiving portion 148 reaches the stop position, the stopper 84 of the cylindrical body 66 abuts on a stop convex portion that is not illustrated and is formed on the rear side of the placement surface 35*a*, so that the cylindrical body 66 stops the rotation at that position. Accordingly, the receiving portion 148 is also stopped at that position, that is, the protrusion position. The another stopper 85 is for stopping the receiving portion 148 at the retraction position (FIGS. 10 and 11). When the receiving portion 148 reaches the retraction position, the stopper 85 of the cylindrical body 66 abuts on another stop convex portion that is not illustrated and is formed on the rear side of the placement surface 35*a*, so that the cylindrical body 66 stops the rotation at that position. Accordingly, the receiving portion 148 is also stopped at that position, that is, the retraction position.

Accordingly, as the cylindrical body 66 rotates around the roller shaft 64, the receiving portion 148 can move between the protrusion position and the retraction position. In the protrusion position (FIGS. 6 to 8), the plurality of receiving portions 148 come into contact with the edge 58 of the rear end 59 of the medium P supported by the support surface 50*a*, and align the rear end 59 of the medium P together with the center contacting wall 141.

Stacking Standing Wall

In the present embodiment, a stacking standing wall 150 that contacts the rear end 59 of the medium P supported by the stacking surface 37*a* of the stacking portion 37 and aligns the medium P is provided. In the present embodiment, the stacking standing wall 150 also serves as the base surface 145 on which the low friction tape 147 is provided. That is, the center contacting wall 141 and the stacking standing wall 150 are flush with each other on the base surface 145, which is a contact surface with the edge 58 of the rear end 59 of the medium P.

Here, the "flush" does not necessarily mean that the contact surfaces 144 and 145 of the center contacting wall 141 and the stacking standing wall 150 are exactly the same surface, but may mean that the contact surfaces 144 and 145 are offset from each other within a range in which the contact surface 144 of the center contacting wall 141 can smoothly guide and stack the dropping medium P onto the stacking surface 37*a*.

In the present embodiment, the recess portion 142 is configured such that at least a part of the rear end 59 of the medium P stacked on the stacking portion 37 can enter the recess portion 142.

FIG. 10 illustrates a moment at which the medium P is dropped from the support surface 50*a* of the medium supporting portion 50 onto the stacking surface 37*a* of the stacking portion 37. At a moment at which the medium P supported by the pair of medium supporting portions 50L and 50R starts to be dropped, is deformed into a "U" shape as a whole, and is dropped onto the stacking surface 37*a*, both corner portions 60 of the edge 58 of the rear end 59 of the medium P are displaced rearward from a position immediately before the medium P is dropped. Due to this displacement, the both corner portions 60 enter the recess portions 142 as indicated by a broken line in FIG. 10. When the medium P has a flat shape without deformation such as curl, the both corner portions 60 are lowered to become flat surfaces, and the broken line portion in FIG. 10 disappears.

However, when the medium P has the deformation such as curl, the rearwardly displaced portion may remain depending on a degree of the deformation. Even in this case, since the recess portion 142 of the present embodiment is configured such that at least a part of the rear end 59 of the medium P stacked on the stacking portion 37 can enter the recess portion 142, the deformed portion can be escaped to the recess portion, and a damage to the medium P in a state of being stacked on the stacking portion 37 can be reduced.

In the present embodiment, the stacking portion 37 has a stacking surface 37*a* inclined upward toward the downstream in the transport direction Ya, and the recess portion 142 has an aligning surface 146 orthogonal to the stacking surface 37*a*.

Here, the "orthogonal" does not mean strict orthogonality, but is used to mean that there is a width within a range in which the deformed portion of the medium P can escape.

According to the present embodiment, since the aligning surface 146 of the recess portion 142 is orthogonal to the inclined stacking surface 37*a* of the stacking portion 37, the rear end 59 of the medium P can be stably aligned using the aligning surface 146 of the recess portion 142.

Avoidance Cam

As illustrated in FIGS. 7 to 11, an avoidance cam 87 is provided next to the transport driving roller 61. The avoidance cam 87 is attached to rotate integrally with the roller shaft 64. The avoidance cam 87 is formed with a large-diameter portion 88, the diameter of which is larger than that of the transport driving roller 61 in a part of a cam surface. The large-diameter portion 88 of the avoidance cam 87 is configured to make a state in which the contact between the medium P and the transport driving roller 61 can be avoided.

As illustrated in FIG. 6, when the avoidance cam 87 discharges the medium P toward the medium supporting portion 50 by the transport driving roller 61, the large-diameter portion 88 is retracted to a position where the large-diameter portion 88 does not contact the medium P.

On the other hand, as illustrated in FIG. 10, after the medium P on the placement surface 35*a* of the medium placement section 35 is discharged to the medium supporting portion 50, waiting for the medium P to be transported from the upstream to the placement surface 35*a* is performed. Otherwise, when the medium P is shifted in the X-axis direction, the large-diameter portion 88 of the avoidance cam 87 is configured to reach a position the contact between the medium P and the transport driving roller 61 is avoided. Accordingly, it is possible to avoid damage and jam caused by the medium P unnecessarily contacting and rubbing the transport driving roller 61.

Explanation of Effect of First Embodiment

The sheet discharging device 30 according to the present embodiment has the above-described configuration, and thus the following effects can be obtained.

(1) According to the present embodiment, the standing wall 140 includes the center contacting wall 141 provided at the center in the width direction X and in contact with the rear end 59 of the medium P, and the recess portions 142 provided on both side areas of the center contacting wall 141 in the width direction X and recessed in a direction away from the support surface 50*a*.

Accordingly, even when the medium P supported by the pair of medium supporting portions 50L and 50R starts to be dropped and is deformed into a U shape as a whole and the both corner portions 60 of the edge 58 of the rear end 59 of the medium P are displaced rearward from a position immediately before the medium P is dropped as described above, the both corner portions 60 of the edge 58 of the rear end 59 can enter the recess portions 142.

Thus, the medium P starts to be dropped in a state in which a central portion of the edge 58 of the rear end 59 thereof contacts the center contacting wall 141, the both corner portions 60 of the edge 58 of the rear end 59 of the medium P enter the recess portions 142, and thus there is little risk of contact with walls of surrounding members. Therefore, it is possible to suppress the position of the bundle of the mediums P dropped onto the stacking portion 37 from varying in the transport direction Ya, and thus to suppress a problem that the stacking position varies in the transport direction Ya.

(2) Further, according to the present embodiment, the center contacting wall 141 guides the medium P to the stacking portion 37 when the medium P is dropped by moving the pair of medium supporting portions 50L and 50R in a direction away from each other. Accordingly, since the medium P starts to be dropped in a state in which the central portion of the edge 58 of the rear end 59 thereof contacts the center contacting wall 141, is guided by the center contacting wall 141 as it is, and is led to the stacking portion 37, it is possible to effectively suppress the position of each bundle of the mediums P dropped onto the stacking portion 37 from varying in the transport direction Ya.

(3) Further, according to the present embodiment, the contact surfaces 144 and 145 of the center contacting wall 141 and the stacking standing wall 150 with the rear end 59 of the medium P are flush with each other. Accordingly, the medium P starts to be dropped in a state in which the central portion of the edge 58 of the rear end 59 thereof contacts the center contacting wall 141, is guided by the center contacting wall 141 as it is, and is delivered to the stacking standing wall 150 of the stacking portion 37. Therefore, the medium P dropped onto the stacking portion 37 is stacked in a state in which the rear end 59 contacts the stacking standing wall 150 of the stacking portion 37 at the dropped position as it is, and it is possible to suppress a problem that the position of the bundle of the mediums P varies in the transport direction Ya.

(4) Further, according to the present embodiment, in a state in which the receiving portions 148 are moved to the protrusion position (FIGS. 6 to 8), the plurality of receiving portions 148 align the rear end 59 of the medium P supported by the support surface 50*a* together with the center contacting wall 141. Accordingly, when the medium P supported by the pair of medium supporting portions 50L and 50R is aligned, both the center contacting wall 141 and the receiving portion 148 contact the rear end 59 of the medium P, so that the medium P is less likely to be tilted in the transport direction Ya, and disturbance of the aligning can be suppressed.

(5) Further, according to the present embodiment, when the medium P supported by the medium supporting portion 50 is dropped, the receiving portion 148 moves to the retraction position (FIGS. 10 and 11), so that the recess portion 142 becomes functional, and a problem that the position of the bundle of the medium P dropped onto the stacking portion 37 varies in the transport direction Ya can be suppressed.

Other Embodiments

Although the sheet discharging device 30 according to an embodiment of the present disclosure basically has the above-described configuration, it is obvious that a partial configuration may be changed or omitted without departing from the scope of the present disclosure.

The recording system 1 may include a plurality of processing devices 4. The recording system 1 may have a structure in which the recording device 2 and the processing device 4 are directly connected to each other and the intermediate device 3 is not provided. The recording device 2 may be equipped with the sheet discharging device 30.

Further, the recording system 1 to which the processing device 4 including the sheet discharging device 30 according to the present embodiment is applied is not limited to a configuration to which an ink jet printer is applied as the printer section 5 and may have a configuration to which a laser printer is applied. The recording system 1 may include the printer section 5 alone without the scanner section 6.

What is claimed is:

1. A sheet discharging device comprising:

a pair of medium supporting portions that are provided to face each other in a width direction intersecting a transport direction in which a medium is transported, have support surfaces that support the medium, and support the transported medium by the support surfaces;

a stacking portion which is provided vertically below the pair of medium supporting portions and on which the medium dropped from the pair of medium supporting portions is stacked; and a standing wall that aligns the medium by contacting a rear end of the medium, in the transport direction, supported by the pair of medium supporting portions, wherein the support surfaces are inclined upward toward a downstream in the transport direction, and the standing wall includes:

a center contacting wall that is provided at a center in the width direction and contacts the rear end of the medium; and recess portions that are provided on both sides of the center contacting wall in the width direction and are recessed in a direction away from the support surfaces.

2. The sheet discharging device according to claim 1, wherein the pair of medium supporting portions are movable in the width direction, and the center contacting wall guides the medium to the stacking portion when the pair of medium supporting portions move in directions away from each other and the medium is dropped.

3. The sheet discharging device according to claim 1, wherein the standing wall further includes a stacking standing wall that aligns the medium by contacting the rear end of the medium supported by a stacking surface of the stacking portion, and the center contacting wall and the stacking standing wall have contact surfaces that contact the rear end of the medium in a same plane.

4. The sheet discharging device according to claim 1, further comprising:

a plurality of receiving portions that are movable between a protrusion position where the receiving portions protrude into the recess portions on both sides of the center contacting wall and a retraction position where the receiving portions are retracted from the recess portions, wherein the plurality of receiving portions align the rear end of the medium supported by the support surfaces together with the center contacting wall in the protrusion position.

5. The sheet discharging device according to claim 4, wherein when the pair of medium supporting portions drop the medium onto the stacking portion, the plurality of receiving portions move to the retraction position.

6. The sheet discharging device according to claim 1, wherein the recess portions are configured so that at least a part of the rear end of the medium stacked on the stacking portion enters.

7. The sheet discharging device according to claim 1, wherein the stacking portion has a stacking surface inclined upward toward the downstream in the transport direction, and the recess portions have aligning surfaces orthogonal to the stacking surface.

8. A processing device comprising:

a processing section that performs processing on a medium;

a pair of medium supporting portions that are provided to face each other in a width direction intersecting a transport direction in which the medium is transported from the processing section, have support surfaces that support the medium, and support the transported medium by the support surfaces;

a stacking portion which is provided vertically below the pair of medium supporting portions and on which the medium dropped from the pair of medium supporting portions is stacked; and a standing wall that aligns the medium by contacting a rear end of the medium in the transport direction supported by the pair of medium supporting portions, wherein the support surfaces are inclined upward toward a downstream in the transport direction, and the standing wall includes:

a center contacting wall that is provided in a center in the width direction and contacts the medium, and recess portions that are provided on both sides of the center contacting wall in the width direction and are recessed in a direction away from the support surfaces.

9. A recording system comprising:

a recording device including a recording section that performs recording on a medium, and a discharge section that discharges the medium on which the recording is performed by the recording section; and a processing device including a medium introducing portion that introduces the medium discharged from the discharge section, a processing section that performs processing on the medium introduced from the medium introducing portion, a pair of medium supporting portions that are provided to face each other in a width direction intersecting a transport direction in which the medium is transported from the processing section, have support surfaces that support the medium, and support the transported medium by the support surfaces, a stacking portion which is provided vertically below the pair of medium supporting portions and on which the medium dropped from the pair of medium supporting portions is stacked, and a standing wall that aligns the medium by contacting a rear end of the medium in the transport direction supported by the pair of medium supporting portions, wherein the support surfaces are inclined upward toward a downstream in the transport direction, and the standing wall includes:

a center contacting wall that is provided in a center in the width direction and contacts the medium, and recess portions that are provided on both sides of the center contacting wall in the width direction and are recessed in a direction away from the support surfaces.

* * * * *